United States Patent [19]

Liu et al.

[11] Patent Number: 5,062,805

[45] Date of Patent: Nov. 5, 1991

[54] STRUCTURE OF CABLE CONNECTOR FOR MATCHING WITH IC MOUNTING SEAT

[75] Inventors: Yun-Yu Liu, Taipei; Hsiao-Lei Shih, Hsin Tien; Yang-Chih Chyou, Chung Ho; Ming-Shing Laiw, Yun Lin Hsien, all of Taiwan

[73] Assignee: Pan-International Industrial Corp., Taipei, Taiwan

[21] Appl. No.: 618,413

[22] Filed: Nov. 27, 1990

[51] Int. Cl.[5] ..... H01R 4/24

[52] U.S. Cl. ..... 439/404; 439/492; 439/507

[58] Field of Search ..... 439/395–401, 439/404, 405, 407, 417–419, 511–513, 68, 525, 507, 492, 999

[56] References Cited

U.S. PATENT DOCUMENTS

| | | | |
|---|---|---|---|
| 4,053,197 | 10/1977 | Geagno | 439/404 |
| 4,066,320 | 1/1978 | Goodrich et al. | 439/402 |
| 4,084,878 | 4/1978 | Wahi | 439/400 |
| 4,552,429 | 11/1985 | van Alst | 439/404 |
| 4,773,876 | 9/1988 | Nakamura et al. | 439/417 |
| 5,000,699 | 3/1991 | Nadin | 439/511 |

*Primary Examiner*—David L. Pirlot

*Attorney, Agent, or Firm*—Fleit, Jacobson, Cohn, Price, Holman & Stern

[57] ABSTRACT

For electrically connecting the bus line from a machine to an IC mounting seat of the electric control circuit of another machine, a cable connector is disclosed comprising a plug seat, an upper cover and a terminal assembly fastened therebetween. The plug seat further comprises an elongated locating seat having a plurality of grooves alternatively vertically disposed at two opposite sides and obliquely aligned with two rows of mounting slots at the two opposite sides thereof for holding the connecting racks of the terminal assembly in place when the contact ends of the terminal assembly are fastened in the mounting slots, as such the bus line at one end of a cable from a machine can be accurately fastened in place and electrically connected to the connecting racks of the terminal assembly, thus, providing for further electric connection to the IC mounting seat of an electric control circuit of another machine through the plug seat.

2 Claims, 4 Drawing Sheets

STRUCTURE OF CABLE CONNECTOR FOR MATCHING WITH IC MOUNTING SEAT

BACKGROUND OF THE INVENTION

The present invention relates to cable connectors, and more particularly relates to a cable connector for connecting the bus line of a cable from an appliance to the IC mounting seat of an electric control circuit board of another appliance.

In the electric control circuit board of a machine, there is generally provided an IC mounting seat for mounting a variety of electronic ICs to control the operation or change the function of the machine. Because electronic ICs are generally fastened in an IC mounting seat through a plug-in connection, they can be conveniently replaced or changed according to requirements. However, in comparison with computers or other precision instruments, electronic ICs can only provide limited functions.

SUMMARY OF THE INVENTION

The present invention has been designed in light of the above. It is therefore a primary objective of the present invention to provide a cable connector which can be conveniently connected between the cable of an instrument and the IC mounting seat of an electric control circuit board of another machine for on-line operation.

According to a first aspect of the present invention, a cable connector is comprised of a plug seat for mounting in an IC mounting seat of an electric control circuit of a machine, an upper cover connected to said plug seat at the top, and a terminal assembly fastened therebetween for connection to a bus line from another machine, wherein the plug seat comprises two rows of mounting slots at two opposite sides, and an elongated locating seat at the top middle, which has a plurality of grooves alternatively vertically disposed at two opposite sides and obliquely aligned with said two rows of mounting slots, convenient for fastening the contact ends and the connecting racks of the terminal assembly in place, allowing the connecting racks of the terminal assembly to be connectable to the bus line from the cable of a machine.

According to a second aspect of the present invention, a cable connector is comprised of a plug seat connected with an upper cover, and a terminal assembly fastened therebetween, wherein the plug seat further comprises a row of projecting strips at the top and is disposed at locations away from the mounting area of the terminal assembly for pressing the bus line which is inserted therein against the inner bottom of the upper cover, permitting the bus line to be firmly retained in place.

According to a third aspect of the present invention, a cable connector is comprised of a plug seat connected with an upper cover, and a terminal assembly fastened therebetween, wherein the upper cover comprises a large face plate which has a plurality of posts extending downward therefrom at two opposite ends, two opposite end walls at two opposite ends which have each a plurality of projecting blocks at the outer side, a shorter side wall at one side and a longer side wall at an opposite side. When the projecting strips of the two opposite end walls of the upper cover are respectively fastened in the plug seat, a bus line mounting hole is defined between the plug seat and the upper cover at one side such that a bus line can be guided by the posts of the upper cover to accurately electrically connect to the connecting racks of the terminal assembly.

DETAIL DESCRIPTION OF THE PREFERRED EMBODIMENT

Figure 1:
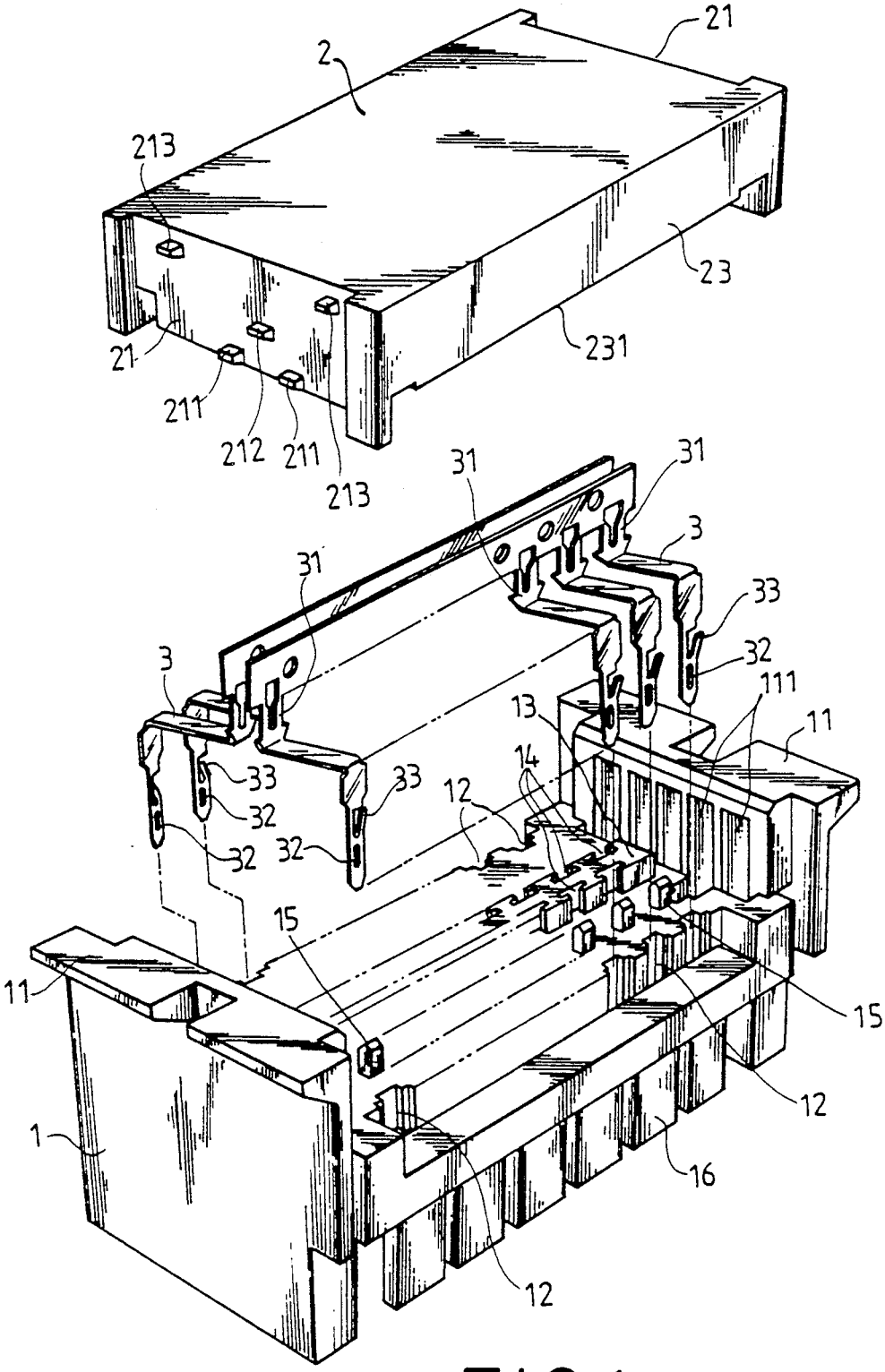
FIG. 1 is a perspective exploded view of the preferred embodiment of the present invention.
Figure 2:
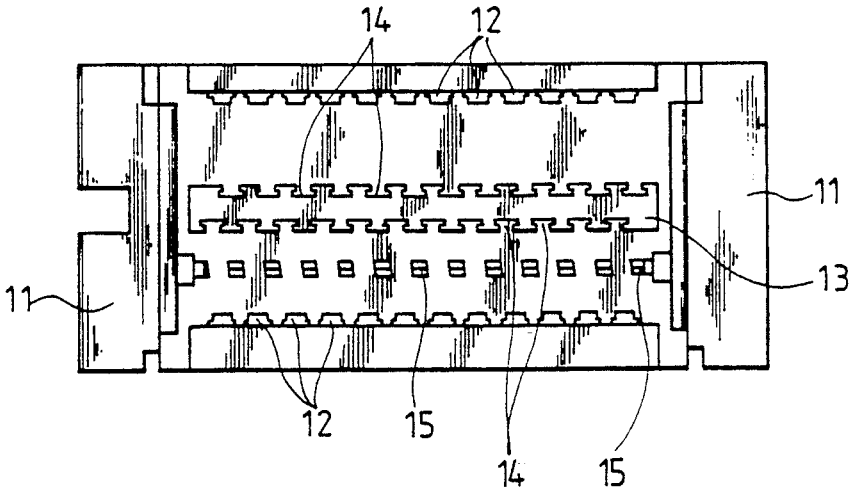
FIG. 2 is a top view of the plug seat thereof.

FIG.1 1 illustrates is a perspective exploded view of a cable connector embodying the present invention which generally comprised of a plug seat 1 for matching with an IC mounting seat, an upper cover 2, and a terminal assembly 3. The plug seat 1 comprises two brackets 11 at two opposite ends each having a plurality of parallel recesses 111 vertically disposed for fastening therein projecting blocks 211, 212, 213 which are made on the two opposite end walls 21 of the upper cover 2, two rows of mounting slots 12 at two opposite sides for mouting the terminal assembly 3, a locating seat 13 at the middle having a plurality of grooves 14 vertically disposed at two opposite sides (wherein the grooves at one side are staggered from the grooves at the opposite side), a plurality of projecting blocks 15 longitudinally disposed between said locating seat 13 and one of said two rows of mounting slots 12 and respectively spaced from one another at interval equal to the interval between said grooves 14 (see FIG. 2), permitting the grooves 14 on the locating seat 13 to be obliquely aligned with the mounting slots 12 for mounting the connecting racks 31 and the contact ends 32 of the terminal assembly 3 obliquely.

Figure 3:
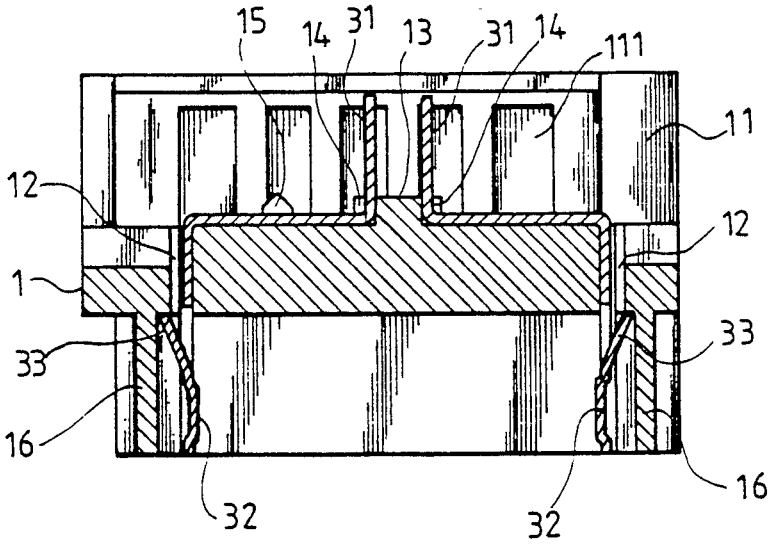
FIG. 3 is a sectional assembly view of the plug seat and the terminal assembly thereof.
Figure 4:
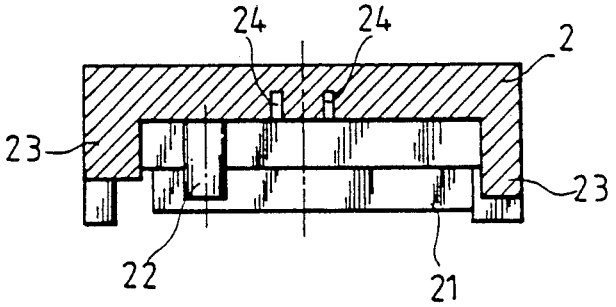
FIG. 4 is a sectional end view of the upper cover thereof.
Figure 5:
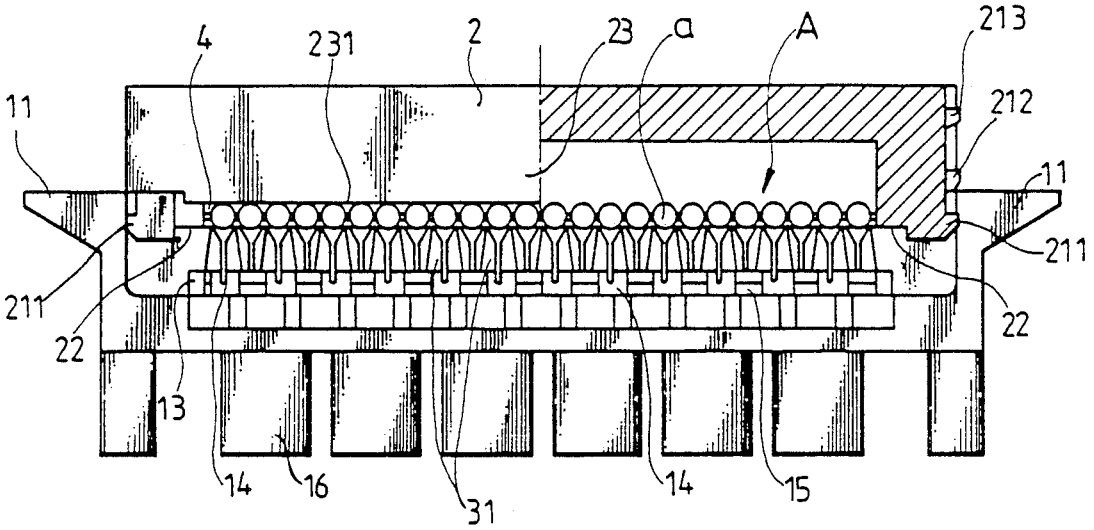
FIG. 5 is a sectional assembly view of the upper cover and the plug seat thereof.
Figure 6:
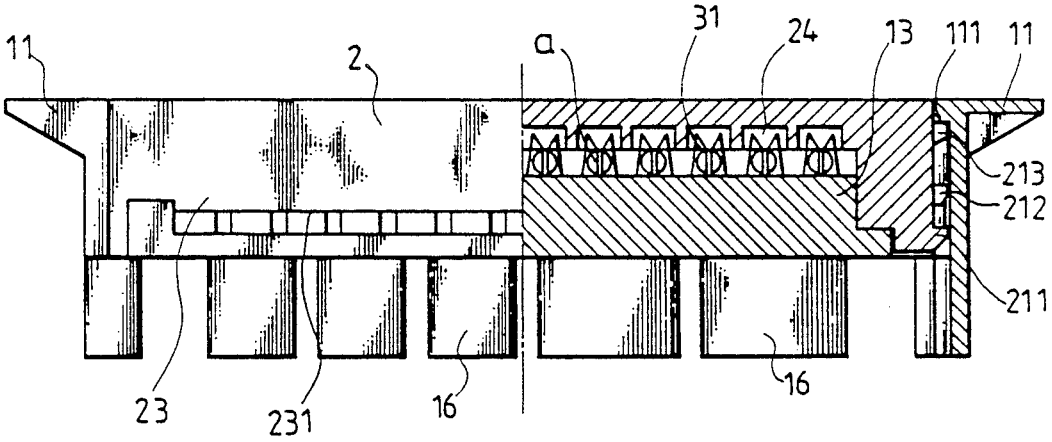
FIG. 6 is a sectional assembly view thereof, illustrating the fastening of the bus line therein.

Referring to FIG. 3, each contact end 32 of the terminal assembly 3 has a unitary, resilient stop strip 33 extending upward between outward therefrom at the outer side. The contact ends 32 of the terminal assembly 3 are respectively inserted in the mounting slots 12 of the plug seat 1 and firmly retained in place by the stop strips 33 thereof to respectively sit within the inner side of the plug pins 16 which are respectively extending downward from the plug seat 1 at two opposite sides. The connecting racks 31 of the terminal assembly 3, obliquely extending from the contact ends 32, are then respectively stably fastened in the grooves 14 of the locating seat 13 at a vertical position. After the terminal assembly 3 is fastened in the plug seat 1, the upper cover 2 is then attached to the plug seat 1 with the projecting blocks 211 of the two opposite ends 21 thereof respectively fastened in the parallel recesses 111 on the two oppoiste brackets 11 of the plug seat 1. The two opposite side walls 23 of the upper cover 2 differ in height (see FIG. 4). The upper cover 2 further comprises two posts 22 respectively disposed at the inner side of the two opposite end walls 21, and a plurality of grooves 24 on the inner bottom and at locations corresponding to the grooves 14 of the locating seat 13. When the projecting blocks 211, which are disposed at a lower position on the end walls 21 of the upper cover 2, are fastened in the brackets 11 of the plug seat 1, the projecting blocks 212, which are disposed at the middle on the end walls 21 of the upper cover 2, are respectively stopped at the top edge of the brackets 11 to stabilize the connection. Because the two opposite side walls 23 differ in height, a bus line mounting hole 4 is thus formed above the locating seat 13 of the plug seat 1 between the bottom edge 231 of the shorter side wall 23 of the plug seat 2 and the connecting racks 31 of the terminal assembly 3 for mounting a bus line (A) (see FIG. 5). Within the constraint of the two posts 22, the bus line (A) can be efficiently inserted into place and disposed above the connecting racks 31 of the terminal assembly 3. Because the racks 31 of the terminal assembly 3 are respectively fastened in the grooves 14 of the locating seat 13 at alternate angles, the conductors (a) of the bus line (A) can be conveninently inserted inside the bus line mounting hole 4 to accurately respectively lay above the racks 31 of the terminal assembly 3. At the same time, the depth at which the bus line (A) is inserted in the bus line mounting hole 4 is confined by the longer side wall 23 of the plug seat 2. Further, the bus line mounting hole 4 is defined at the side where the projecting blocks 15 are disposed. Therefore, after the bus line (A) is accurately inserted into the bus line mounting hole 4 and disposed right above the racks 31 of the terminal assembly 3, the upper cover 2 is further squeezed downward against the plug seat 1, permitting the projecting blocks 213, which are disposed at a higher position on the two opposite end walls 21 of the upper cover, to be respectively fastened in the parallel recesses 111 of the brackets 11 of the plug seat 1 (see FIG. 6). Thus, the conductors (a) of the bus line (A) are respectively squeezed in the racks 31 of the terminal assembly 3 so as to become electrically connected with the top edge of the racks 31 of the terminal assembly 3 fastened in the grooves 24 on the inner bottom of the upper cover 2. Therefore, the conductors (a) of the bus line (A) are firmly retained in the racks 31 of the terminal assembly 3. After the upper cover 2 is firmly secured to the plug seat 1, the projecting blocks 15 of the plug seat 1 inside the bus line mounting hole 4 are simultaneously forced to press the bus line (A) against the inner bottom of the upper cover 2 so as to firmly secure the bus line (A) in position.

Figure 7:
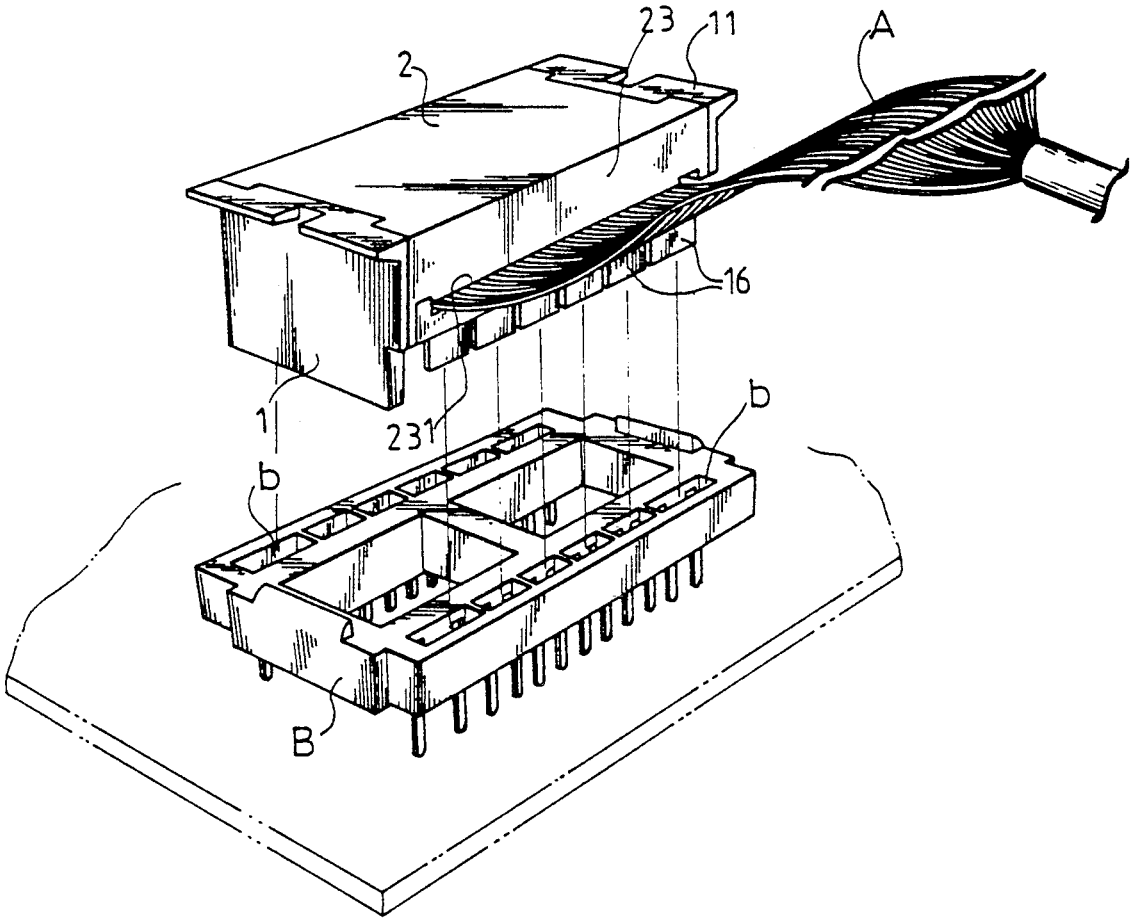
FIG. 7 is a schematic drawing illustrating an application of the present invention to match with an IC mounting seat.

When in use, the plug pins 16 at the two opposite sides of the plug seat 1 are respectively inserted in the plug holes (b) on an IC mounting seat (B). Because the quantity of the plug pins 16 are designed according to the plug holes (b) of the IC mounting seat (B), the plug seat 1 can be conveniently mounted on the IC mounting seat (B) (see FIG. 7). As soon as the plug seat 1 is mounted on the IC mounting seat (B), the contact ends 32 of the terminal assembly 3 which are disposed at the inner side of the plug pins 16 are electrically connected to the terminals in the plug holes (b) of the IC mounting seat (B). Therefore, the appliance (e.g. computer) to which the bus line (A) in the plug seat 1 is attached can be connected to the equipment to which the IC mounting seat (B) is connected for on-line operation.

We claim:

1. A cable connector, comprising a plug seat for mounting in an IC mounting seat of an electric control circuit of a machine, an upper cover connected to said plug seat at the top, and a terminal assembly fastened therebetween for connection thereto of a bus line from another machine;

said plug seat comprising a plurality of plug pins at two opposite sides for fastening in a plurality of plug holes made on said IC mounting seat, two brackets at two opposite ends, said brackets having each a plurality of parallel recesses at an inner side, two rows of mounting slots at two opposite sides within said plug pins, an elongated locating seat at a top portion middle, said locating seat having a plurality of grooves alternatively vertically disposed at two opposite sides and obliquely aligned with said mounting slots, and a row of projecting strips longitudinally disposed at a top portion between said locating seat and one of said two rows of mounting slots;

said upper cover comprising a large face plate, two opposite end walls at two opposite ends, a shorter side wall at one side and a longer side wall at an opposite side, said face plate having a plurality of posts extending downward therefrom at two opposite ends, said end walls having each a plurality of projecting blocks respectively disposed at lower, middle and upper positions;

said terminal assembly comprising a plurality of contact ends respectively obliquely curvilinearly extending downward from a plurality of connecting racks; and wherein said contact ends of said terminal assembly are respectively fastened in said mounting slots, said connecting racks of said terminal assembly are respectively vertically fastened in said grooves of said locating seat, the projecting blocks at lower and middle positions on said end walls of said upper cover are respectively fastened in said parallel recesses of said brackets of said plug seat to define a bus line mounting hole between the bottom edge of said shorter side wall of said upper cover and a top edge of said connecting racks of said terminal assembly for mounting a bus line in the space defined within said posts of said face plate, permitting said connecting racks of said terminal assembly to be further squeezed by said upper cover to respectively pierce in said bus line and electrically connect the conductors thereof.

2. The cable connector of claim 1, wherein said face plate of said upper cover has a plurality of grooves on an inner bottom of said face plate and at locations corresponding to the grooves on the two opposite sides of said locating seat for holding said connecting racks of said terminal assembly.

* * * * *